United States Patent [19]

Bard et al.

[11] 4,104,953

[45] Aug. 8, 1978

[54] MACHINE GUN BARREL FOR FIRING BLANKS

[75] Inventors: Charles L. Bard, Rock Island, Ill.; Raymond W. Pfitzenmaier, Davenport, Iowa

[73] Assignee: The United States of America as represented by the Secretary of the Army, Washington, D.C.

[21] Appl. No.: 768,241

[22] Filed: Feb. 14, 1977

Related U.S. Application Data

[63] Continuation-in-part of Ser. No. 608,485, Aug. 28, 1975, abandoned.

[51] Int. Cl.[2] ..... F41F 17/08; F41F 17/12

[52] U.S. Cl. ..... 89/14 E; 89/16; 89/29

[58] Field of Search ..... 89/14 SB, 14 E, 14 C, 89/29, 16, 14 R

[56] References Cited

U.S. PATENT DOCUMENTS

| | | | |
|---|---|---|---|
| 2,110,165 | 3/1938 | Moore | 89/14 E |
| 2,112,831 | 4/1938 | Cutts | 89/14 E |
| 2,315,207 | 3/1943 | Janecek et al. | 89/14 SB |
| 2,362,996 | 11/1944 | Green | 89/14 E |
| 2,589,171 | 3/1952 | Vironda | 89/14 C X |
| 2,602,255 | 7/1952 | Cutts | 89/14 C X |
| 2,837,856 | 6/1958 | Benitez | 89/14 C X |
| 3,137,204 | 6/1964 | Harvey | 89/14 E |
| 3,492,750 | 2/1970 | Ashbrook et al. | 89/14 C X |
| 3,710,683 | 1/1973 | Kaltmann | 89/14 B |
| 3,766,822 | 10/1973 | Sophinos | 89/14 E |

*Primary Examiner*—David H. Brown

*Attorney, Agent, or Firm*—Nathan Edelberg; Harold Card; Robert O. Richardson

[57] ABSTRACT

A machine gun barrel for firing blanks comprising a reclaimed quick disconnect barrel with a one piece blank firing attachment with diminished orifice replacing the flash suppressor and threadedly mounted over the barrel end provides gas build-up necessary for gun operation without leakage. Accidental live round firing causes forward, not lateral, fragmentation of the attachment because of its conical bore configuration.

4 Claims, 4 Drawing Figures

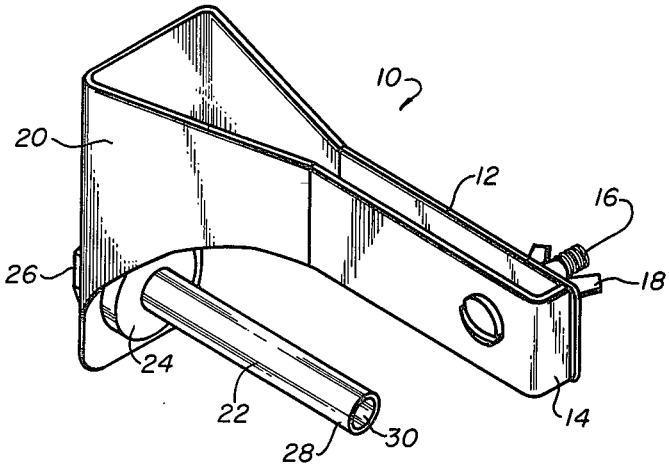
FIG. 1
FIG. 2
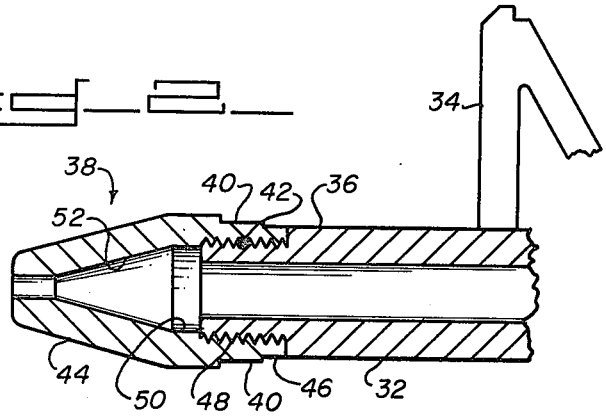
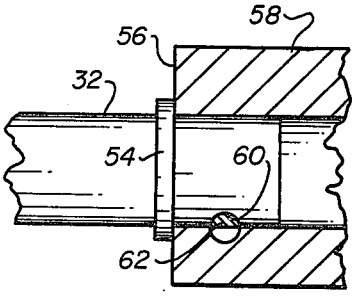
FIG. 3
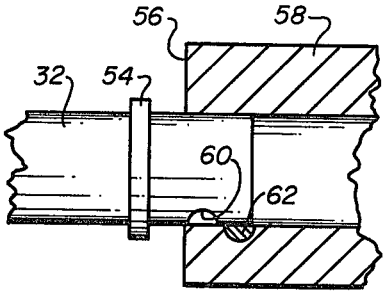
FIG. 4

MACHINE GUN BARREL FOR FIRING BLANKS

GOVERNMENT RIGHTS

The invention described herein may be manufactured and/or used by or for the Government for governmental purposes without the payment of any royalty thereon.

RELATED APPLICATIONS

This is a continuation in part of our co-pending application Ser. No. 608,485 filed Aug. 28, 1975 for Machine Gun Barrel for Firing Blanks, now abandoned.

BACKGROUND OF THE INVENTION

Machine guns, such as the Army M60 family, are gas operated and require gas pressure generated when a cartridge is fired to recycle the gun for loading and firing the next cartridge. This gas pressure is built up behind the projectile before it leaves the gun barrel and becomes the pressure source for the subsequent movement of operating parts.

Firing blank ammunition is often done in troop training to provide realism to the training. For example, machine guns firing blanks are trained on our own troops as they advance on enemy installations in war games and other training exercises. With blank cartridges there is no bullet leaving the gun barrel behind which gunpowder generated gases are pressurized and, without some other impedance to the gases, they simply pass out of the barrel. There then is no pressurization of the gases to ready the gun for firing the next round.

To achieve the necessary gas pressurization while still using blanks, a prior art adapter has been devised for restricting the gas flow from the end of the barrel. This adapter has a restrictor tube that fits within the flash suppressor at the end of the barrel and is held in position with a sheet metal bracket clamped to the vertical post of the front sight of the gun.

The foregoing adapter has several defects. It required precise machining to fit snugly into the flash suppressor. After short use gas leaks developed between it and the end of the gun barrel. Since it consisted of several parts, it was costly to make and assemble. It also had a safety hazard in that if a live round of ammunition was accidentally fired, it shattered into laterally projected shrapnel which became a potential danger to the operator. Since this adapter is detachable from the gun as a practical matter in the field, many get lost and have to be replaced.

SUMMARY OF THE PRESENT INVENTION

In accordance with the present invention, a discarded machine gun barrel is used in the firing of blank cartridges. A machine gun typically uses six to eight barrels over the life of the gun, so discarded gun barrels should be easily obtainable and in ample supply. The used barrels are periodically checked to determine usable service life. They undergo a thorough examination, checking such things as bore errosion, headspace, inaccuracy, protective finish, etc. Any of these might be cause to reject a barrel from service. Such a barrel then becomes a service rejected barrel. However, only the headspace requirement need be met for a barrel to be capable of firing blank ammunition. Thus, barrels rejected for reasons other than headspace are readily reclaimable for use in firing blanks. These barrels become reclaimed barrels.

After selecting a reclaimable barrel, the flash suppressor, which is threadedly mounted on the barrel end, is then removed and replaced by a one piece blank firing attachment with a conical bore terminating in a diminished orifice. The reclaimed barrel thus modified becomes a machine gun barrel suitable for firing blank ammunition.

It is easier and quicker to exchange a barrel used for firing live rounds for the reclaimed barrel as modified above for firing blanks than it is to attach an adapter to the first barrel. Moreover, a gun barrel adapted for firing blanks only can be color coded, such as by painting the front sight and front end attachment bright red, to readily distinguish this barrel from one capable of firing live rounds.

In the event a live round is fired by accident, this attachment splinters and sends shrapnel downrange instead of laterally as does the prior art adapter. The previous adapter to a serviceable barrel costs on the order of $6, whereas the present attachment for a discarded barrel costs on the order of $1. At the rate of 20,000 a year, this represents a $100,000 a year saving plus the saving associated with accountability and destruction costs on nonusable military equipment.

BRIEF DESCRIPTION OF DRAWINGS

FIG. 1 is a perspective view of a prior art adapter through which blank cartridges are fired;

FIG. 2 is a side elevational view taken in section of a gun barrel with an attachment for firing blanks in accordance with the present invention;

FIG. 3 is a side elevational view in partial section showing a quick disconnect barrel in the latched position; and FIG. 4 is similar to FIG. 3 showing the barrel unlatched and partially withdrawn.

DETAILED DESCRIPTION OF ILLUSTRATIVE EMBODIMENT

Reference is made to FIG. 1 which shows the prior adapter 10 used with a serviceable gun barrel and presently used with the Army M60 machine gun. It consists of a U-shaped sheet metal bracket 12 having ends 14 engagable with the front sight (not shown) of a gun barrel. A bolt 16 with wingnut 18 is used to clamp the bracket 12 in position. The U-shaped portion 20 extends downwardly and has a tube 22 attached thereto. Preferably tube 22 has a collar 24 which bears against the inside of the U-shaped portion 20. The tube passes through an aperture and terminates in a threaded shaft over which a nut 26 and washer, not shown, are inserted to maintain the tube as shown. This tube is accurately machined on its outer surface to fit within the flash suppressor, not shown, on the end of the gun. End 28 fits against the end of the barrel to confine propellant gases. Tube 22 has a bore 30 having a diameter at end 28 of comparable size to the gun barrel. This bore tapers to a smaller size under nut 26 so that the gases from the blank cartridge cannot escape fast enough and thus build up a gas pressure instead.

As previously noted, this adapter developed gas leakage between end 28 and the gun barrel. It consists of several parts to be made, assembled and then installed on the gun barrel. A live round accidentally fired would cause the adapter to splinter and eject laterally, creating a safety hazard.

In FIG. 2 there is shown a cross-sectional view of a barrel 32 with a blank cartridge firing attachment 38 threadedly mounted thereon. This barrel preferably is one that had been discarded as unsuitable for further use in firing live rounds of ammunition. Typically, front sight 34 remains fixed to it but the flash suppressor, which had been threadedly affixed to the front end 36, has been replaced with the blank cartridge firing attachment 38. This attachment has been threadedly inserted over end 36 and tightened with a wrench on flats 40 thereon. A pin 42 in an aperture prevents accidental removal of the attachment.

As can be seen, attachment 38 has a truncated conical outer surface 44 which terminates rearwardly in a reduced cylindrical wall 46 of the same size as end 36 in front of sight 34 on barrel 32. This serves as a bearing surface for the neck of a bipod, not shown, which fits between the attachment 38 and front sight 34.

Here can also be seen a threaded inner surface 48 for attachment to the gun barrel. Its diameter is on the order of 0.625inch and it length is approximately 0.60 inch. Thereafter the diameter drops to 0.50 inch at 50 to form a shoulder abutting the end of the gun barrel when it is installed. This diameter of 0.50 inch continues about 0.15 inch and then reduces about 0.480 inch to 0.145 inch over a 0.75 inch length 52. The reduced diameter of 0.145 inch continues for 0.25 inch which is the thickness of the end of the attachment. The overall length of the attachment is 1.75 inches and its largest outside diameter is 1.00 inch.

Should a live round be fired, the slope 52 is such that the shrapnel generated in bursting the outer end is carried downrange rather than laterally as in the prior art adapter.

Reference is now made to the quick disconnect barrel 32 shown in FIG. 3 and in FIG. 4. The longitudinal position of this barrel is controlled by an annular ridge 54 which abuts the front surface 56 of the receiver 58. This provides for proper alignment between a recess 60 in the barrel and the barrel latch 62. As shown in FIG. 3, the barrel latch 62 engages the recess 60 which retains the barrel 32 in the receiver 58. To remove the barrel, the latch 62 is rotated 180° by a handle (not shown) to the position shown in FIG. 4. The barrel 32 may then be forwardly withdrawn from the weapon receiver 58.

Having thus described an illustrative embodiment of the present invention as it applies to a particular gas operated weapon, other forms and uses with other weapons will become obvious to one skilled in the art and it is to be understood that these modifications are to be considered as part of the present invention as set forth in the following claims.

What is claimed is:

1. A machine gun barrel for firing blanks comprisng:

a service rejected reclaimed quick disconnect barrel adapted to replace a serviceable barrel and to fit onto a machine gun capable of firing said blanks, an attachment threadedly fastened to the outer end of said barrel, said attachment being of an integral one piece construction and having at one end thereof a bore with a first diameter of sufficient size to fit over said outer end of said barrel, said bore having a reduced diameter at the other end of said attachment, said bore having a truncated conical surface interconnecting those ends having said first diameter and said reduced diameter, said attachment having a cylindrical outer surface terminating at one end in a truncated conical outer surface and a reduced cylindrical surface of size approximately equal to that of said gun barrel, said cylindrical outer surface having wrench grippable flats thereon to facilitate installation on said barrel.

2. The method of making a machine gun barrel for firing blanks comprising the steps of:

a. selecting a service rejected but reclaimable barrel having a flash suppressor threadedly affixed to its outer end, b. providing an integral one piece construction attachment having at one end thereof a bore with a first diameter of sufficient size to fit over the outer end of the barrel, the bore having a reduced diameter at the other end of the attachment, the bore having a truncated conical surface interconnecting these ends, c. removing the flash suppressor and threadedly fastening said attachment to the outer end of said barrel, and d. replacing the serviceable barrel of a machine gun with said service rejected but reclaimable barrel with said attachment fastened thereon.

3. The method of claim 2 wherein the front sight and the attachment are distinctively marked to remind the operator to fire blanks and not to fire live ammunition.

4. The method of claim 3 wherein the front sight and attachment are painted red.

* * * * *